US007114595B2

(12) United States Patent
Urata

(10) Patent No.: US 7,114,595 B2
(45) Date of Patent: Oct. 3, 2006

(54) METHOD OF ASSIGNING ELEVATORS FOR SKY LOBBIES

(75) Inventor: Masazumi Urata, Tokyo-to (JP)

(73) Assignee: Otis Elevator Company, Farmington, CT (US)

( * ) Notice: Subject to any disclaimer, the term of this patent is extended or adjusted under 35 U.S.C. 154(b) by 418 days.

(21) Appl. No.: 10/661,185

(22) Filed: Sep. 11, 2003

(65) Prior Publication Data

US 2005/0077116 A1 Apr. 14, 2005

(51) Int. Cl.
*B66B 1/18* (2006.01)

(52) U.S. Cl. ..... 187/382

(58) Field of Classification Search ..... 187/380–389
See application file for complete search history.

(56) References Cited

U.S. PATENT DOCUMENTS

| | | | | |
|---|---|---|---|---|
| 5,554,832 | A * | 9/1996 | Lumme et al. | 187/380 |
| 6,315,083 | B1 * | 11/2001 | Schuster et al. | 187/391 |
| 6,382,363 | B1 * | 5/2002 | Friedli | 187/384 |
| 2001/0022252 | A1 * | 9/2001 | Schuster | 187/247 |

OTHER PUBLICATIONS

Kenchiku Sekkei—shiko no tame no shinkoki keikaku shishin (Guidelines for elevator plans in the design and construction of buildings), published 1992 by Japan Elevator Association.

* cited by examiner

*Primary Examiner*—Jonathan Salata

(57) ABSTRACT

An elevator operation system and apparatus reduce the round trip time of an elevator, by determining a target floor that corresponds to the destination floor requested by a passenger; and assigning the target floor to one of a plurality of elevators for service exclusively to the target floor.

7 Claims, 11 Drawing Sheets

FIG.4

EVALUATION OF SHUTTLE ELEVATORS IN AN ULTRAHIGH BUILDING

| | OPERATION PATTERN IN PRIOR ART | SYSTEM OF THIS INVENTION | | |
|---|---|---|---|---|
| | | OPERATION PATTERN A | OPERATION PATTERN B | OPERATION PATTERN C |
| 400m | SKY LOBBY (c) | SKY LOBBY (c) | SKY LOBBY (c) | SKY LOBBY (c) |
| 300m | SKY LOBBY (b) | SKY LOBBY (b) | SKY LOBBY (b) | SKY LOBBY (b) |
| 200m | SKY LOBBY (a) | SKY LOBBY (a) | SKY LOBBY (a) | SKY LOBBY (a) |
| 100m | | | | |
| 0m | BUILDING LOBBY | BUILDING LOBBY | BUILDING LOBBY | BUILDING LOBBY |
| ROUND TRIP TIME | 204.06 SEC. | 117.45 SEC. | 142.45 SEC. | 167.45 SEC. |
| TRANSPORTING ABILITY (PER 5 MIN.) | 64.68 PASSENGERS | 112.38 PASSENGERS | 92.66 PASSENGERS | 78.82 PASSENGERS |
| AVERAGE ROUND TRIP TIME | 204.06 SEC. | | 142.45 SEC. | |
| AVERAGE TRANSPORTING ABILITY (PER 5 MIN.) | 64.68 PASSENGERS | | 94.62 PASSENGERS | |
| KEY | P PIT M MECHANICAL CHAMBER L LOBBY SERVICE FLOOR EXPRESS REGION | | | |

FIG.5

EVALUATION OF SHUTTLE ELEVATORS IN AN RELATIVELY LOW BUILDING (MEETING HALL, MOVIE THEATER, STORE, ETC.)

| | OPERATION PATTERN IN PRIOR ART | SYSTEM OF THIS INVENTION | | |
|---|---|---|---|---|
| | | OPERATION PATTERN A | OPERATION PATTERN B | OPERATION PATTERN C |
| 30m | FLOOR (c) | FLOOR (c) | FLOOR (c) | FLOOR (c) |
| 20m | FLOOR (b) | FLOOR (b) | FLOOR (b) | FLOOR (b) |
| 10m | FLOOR (a) | FLOOR (a) | FLOOR (a) | FLOOR (a) |
| 0m | BUILDING LOBBY | BUILDING LOBBY | BUILDING LOBBY | BUILDING LOBBY |
| ROUND TRIP TIME | 118.07 SEC. | 67.78 SEC. | 81.12 SEC. | 94.45 SEC. |
| TRANSPORTING ABILITY (PER 5 MIN.) | 55.90 PASSENGERS | 97.37 PASSENGERS | 81.36 PASSENGERS | 69.88 PASSENGERS |
| AVERAGE ROUND TRIP TIME | 118.07 SEC. | | 81.11 SEC. | |
| AVERAGE TRANSPORTING ABILITY (PER 5 MIN.) | 55.90 PASSENGERS | | 82.87 PASSENGERS | |
| KEY | P PIT M MECHANICAL CHAMBER L LOBBY SERVICE FLOOR EXPRESS REGION | | | |

METHOD OF ASSIGNING ELEVATORS FOR SKY LOBBIES

FIELD OF THE INVENTION

This invention pertains to a type of elevator system that can move up/down along an elevator shaft in a building. More specifically, this invention pertains to an elevator operating system and elevator operation method characterized by the fact that it can improve the operation efficiency of the dedicated shuttle elevators for the sky lobbies in an ultrahigh building.

BACKGROUND OF THE INVENTION

Usually, as buildings become higher, the space occupied by elevators becomes greater, and the usable space in the building becomes smaller. For example, in Landmark Tower in Yokohama, Japan, about ⅓ the total space is occupied by elevators.

As a means for improving the efficiency of elevators in ultrahigh buildings, the sky lobby system has been proposed. In this system, a sky lobby is provided as a transit lobby on a floor at nearly the midpoint of the total height of the building. A shuttle elevator is provided that is dedicated (goes directly) to the sky lobby, and the main line (local elevators) is divided into upper and lower portions so as to achieve economic design (with space and energy reduction). (The name "sky lobby" comes from the fact that it is located in the sky as viewed from the lobby near the ground).

The sky lobby system has been adopted in the Petronas Towers in Malaysia, the Jingmao Building and Bank of China Buildings in China, Central Plaza in Hong Kong, the T&C Tower in Taiwan, as well as the Yamao Park Tower and the Roppongi 1-Chome Plan Building in Japan.

This system has been found to have significant advantages for buildings 200 m high or higher. On the other hand, when the building is super high (400 m or higher), more than one sky lobby may be provided as an economic design.

However, when several sky lobbies are provided (for example, when a sky lobby is provided for every 150 m in a building 750 m high), when conventional elevator operation is used, the time for the shuttle elevator to complete a trip becomes much longer, and the service level becomes much poorer. As a result, many more elevators are needed.

This is because, for large cars (with a rating of 40–68 passengers), the time for passengers to get on and off the car becomes longer, so that the time to complete each trip becomes longer for each elevator, the average time between starts becomes longer, and the transporting ability is reduced.

In the following, the operation method for a conventional elevator system will be explained with reference to FIGS. 6–13. FIG. 6 is a diagram illustrating a conventional group management system. In this system, all of elevators A–D stop at all of the floors. Consequently, the passenger riding on the elevator can reach any desired target floor. Also, due to group management, there is little likelihood that the passenger will wait a long time. In FIG. 6, the circles indicate the floors to which the elevator provides service (same in following FIGS. 7–10).

On the other hand, because passengers going to lower floors and passengers going to higher floors share the same elevator, the time it takes for passengers to reach higher floors becomes longer, especially during the rush hour, and a longer time is needed for the elevator to return to the lobby (the ground floor building lobby). As a result, more passengers have to wait, and the lobby becomes crowded. This is undesirable.

FIG. 7 is a diagram illustrating the rush hour division service system. As indicated by hatched zones in the figure, the service floors for each elevator are limited during the rush hour. For example, the service floors for units A and B are limited to the $2^{nd}$–$6^{th}$ floors, and the service floors for units C and D are limited to the $7^{th}$–$11^{th}$ floors.

In this system, passengers going to the same target floor go together, so that the riding time can be shortened, and the car can return to the lobby more quickly, so that the lobby is not so crowded. This is an advantage. On the other hand, however, when there are many passengers in a certain group, the lobby becomes crowded, while the elevators for other groups are idled. This is undesirable. In addition, the number of elevators that can be selected by each passenger is halved, so that the wait time becomes longer. This is also undesirable.

FIGS. 8–10 illustrate the so-called channeling system for further improving the rush hour division service shown in FIG. 7. First of all, as shown in FIG. 8, the service floors are limited to a few floors (floors are divided to sectors), and elevators are assigned to respective sectors.

In this case, one elevator unit is not assigned to any sector (unit D in FIG. 8), and the elevators assigned to the sectors represent the various service floors (floors indicated by hatched areas).

FIG. 9 is a diagram illustrating the situation in which passengers have entered elevator unit A for departure. Simultaneously with said departure, the service floor display for unit A is erased, and the sector of the departing elevator (that is, sector 3) is assigned to the elevator that had no service floors displayed (that is, unit D). As a result, the service floor display of elevator unit D becomes "$9^{th}$–$11^{th}$ floors."

When the elevators depart one by one, the elevator that returns first is assigned to an empty sector. As shown in FIG. 10, unit C has departed, so that the display of "$6^{th}$–$8^{th}$ floors," as shown in FIG. 9, is erased. Instead, "$6^{th}$–$8^{th}$ floors" is displayed as the service floors for unit A that had no display in the situation shown in FIG. 9. As shown in FIG. 10, for unit A it is displayed that service for the $9^{th}$ floor and $10^{th}$ floor, assigned as shown in FIG. 9, is terminated, and the elevator is now on the $10^{th}$ floor; for unit B it is displayed that service for the $3^{rd}$ floor, $4^{th}$ floor and $5^{th}$ floor, assigned as shown in FIG. 9, is terminated, and the elevator is now on the $5^{th}$ floor. On the other hand, for unit D it is displayed that the elevator is now on the lobby floor.

For the aforementioned rush hour division service shown in FIG. 7, because the elevators for sectors are fixed, one has to wait until an elevator returns once it has departed. On the other hand, for the channeling system shown in FIGS. 8–10, because an empty section is assigned to the first elevator that returns, there is no need to wait for an elevator for a long time. As a result, it is possible to prevent crowding in the lobby, and it is possible to reduce the service time as the wait time becomes shorter.

However, because the number of sectors and the number of floors are fixed in the channeling (static channeling) shown in FIGS. 8–10, if a large number of passengers wants to travel to a certain floor at the same time, the riding time for the sector containing said floor becomes longer, and the overall service level for the entire sector may degrade.

In order to solve this problem, the so-called dynamic channeling system shown in FIGS. 11–13 is adopted. In this system, the total number of passengers is counted, and changes are made to the number of sectors and numbers of floors so as to have uniform distribution of passengers among the various sectors.

For example, in a situation with the settings shown in FIG. 11, the number of sectors is 3; the number of floors in the sector for unit A is 3; the number of floors in the sector for unit B is 4; and the number of floors in the sector for unit C is 3. When passengers are concentrated on a certain floor, as shown in FIG. 12, changes can be made to the settings to reduce the number of floors for the sector containing said floor that is the destination for many passengers. That is, the number of floors in the sector for unit A is changed to 2; the number of floors in the sector for unit B is changed to 7; and the number of floors in the sector for unit C is changed to 1.

On the other hand, when the distribution of the passengers is even, as shown in FIG. 13, the number of sectors is 2, the number of floors in the sector for unit A is 5, and the number of floors in the sector for unit B is 5.

In this way, as the distribution in the number of passengers for various floors changes, the sectors are adjusted to cope with variations in the passenger flow over time. Consequently, the cycle time for the elevators becomes shorter, and service to the sectors can be improved.

In this case, there are various criteria, as listed below, used for evaluation of elevators (JIS) (reference: "Kenchiku sekkei•shiko no tame no shinkoki keikaku shishin" [Guidelines for elevator plans in the design and construction of buildings], published 1992 by Japan Elevator Association).

(1) Round trip time.

The time from return of the car to the start floor to return again of the car to the start floor after having carried passengers from the start floor to upper floors.

(2) Average round trip time.

Average round trip time=travel time+door open/close time+time for passengers getting on and off+loss time (sec).

(2-1) The travel distance and the number of travel segments (accelerations/decelerations) are included in the travel time.

(2-2) The predicted number of stops is included in the door opening/closing time, time for passengers getting on and off and loss time.

(3) Average departure interval round trip time/number of units (sec).

(4) 5-min transporting ability 300/average departure interval×number of passengers riding (number of persons).

However, in the conventional operation method, there are multiple floors served by any given elevator among the multiple elevator units. Consequently, the round trip time from departure to return to the starting floor after serving multiple floors is long.

For example, even when the number of floors served is changed, as with the dynamic channeling system shown in FIG. 12, multiple floors are assigned to any given elevator as service floors. Consequently, the round trip time becomes longer.

This problem becomes more significant when the building becomes higher and the number of floors is increased. For example, in a skyscraper with a shuttle elevator, because the original shuttle elevator serves for express travel to the sky lobby, said items (2-1), (2-2) are counted only twice, and high efficiency can be realized in the operation.

However, when more than one sky lobby is provided, just as with a conventional elevator, sequential stop service is provided, and, finally, the criteria pertaining to the predicted number of stops (running cycle number[sic], door opening/closing time, time for passengers getting on and off, loss time) are added to the round trip time, so that the round trip time becomes much longer.

For a conventional elevator in actual operation, when a passenger near the inside wall wants to exit the car, passengers standing near the door have to get off and then back on the car again. Taking this scenario into consideration for said sky lobbies in a skyscraper, the loss time is expected to become longer.

For the shuttle elevator in the sky lobby scheme, although an elevator system is adopted, it is actually like an express bus system, that is, a new traffic system.

The purpose of this invention is to solve the aforementioned problems of the prior art by providing a type of elevator operation system and elevator operation method characterized by the fact that it can shorten the round trip time of elevator, optimize the general elevator operation characteristics and application characteristics of a shuttle elevator, and improve the service level.

SUMMARY OF THE INVENTION

In order to solve the aforementioned problems, this invention provides a type of elevator operation system characterized by the following facts: the elevator operation system is for operating plural elevators arranged co-located in a building; the system has a means for setting a unique service floor for each elevator, with these floors being different from each other; a first-arriving elevator predicting means that predicts which elevator among said plural elevators will arrive at the building ground floor lobby first; a target floor determining means that determines the elevator target floor from among said preset service floors corresponding to target floor requests; and a target floor assigning means that assigns the target floor determined with said target floor determining means as the target floor for the elevator predicted with said first-arriving elevator predicting means; said assigned elevator runs to the assigned target floor.

Also, this invention provides an elevator operation method characterized by the following facts: the operation method is for operating plural elevators co-located in a building; in this operation method, the following kinds of processing are carried out: setting processing that sets a unique service floor for each elevator, with these floors being different from each other; prediction processing that predicts which elevator among said plural elevators will arrive first at the building ground floor lobby; determination processing that determines the elevator target floor from among said preset service floors corresponds to target floor requests; and assignment processing that assigns the target floor determined in said determination processing as the target floor for the elevator predicted by said prediction processing; said assigned elevator runs to the assigned target floor.

As explained in the above, this invention has the following advantageous effects.

The round trip time is reduced for each elevator. The average round trip time for all of the elevators is significantly reduced. As a result, the service level is improved. Because the round trip time of the elevator is reduced, the departure interval becomes shorter, the transporting ability (such as the 5-min transporting ability) is increased, and the average transporting ability of all of the elevators is increased significantly. Consequently, the number of elevator cars required can be significantly reduced.

The aforementioned effects are not limited to single-deck elevators. The same effects can be also be realized for the double-deck elevator. In addition, the aforementioned effects become more significant as the building becomes higher. For example, the effect is excellent when this invention is adopted in an elevator system that has plural sky lobbies with express operation being performed between the building lobby and the sky lobbies.

BRIEF DESCRIPTION OF DRAWINGS

FIG. 4 is a diagram illustrating evaluation when this invention is adopted for the shuttle elevators of a skyscraper.

FIG. 5 is a diagram illustrating evaluation when this invention is adopted for the elevators in a relatively low building.

DETAILED DESCRIPTION OF THE PREFERRED EMBODIMENTS

Embodiments of this invention will be described in the following, illustrated by figures.

Figure 1:
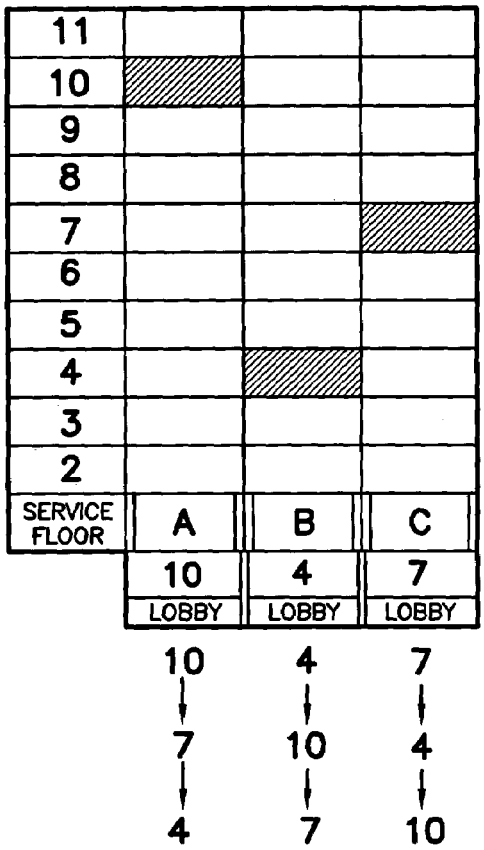
FIG. 1 is a diagram illustrating the elevator operation method in an embodiment of this invention.
Figure 2:
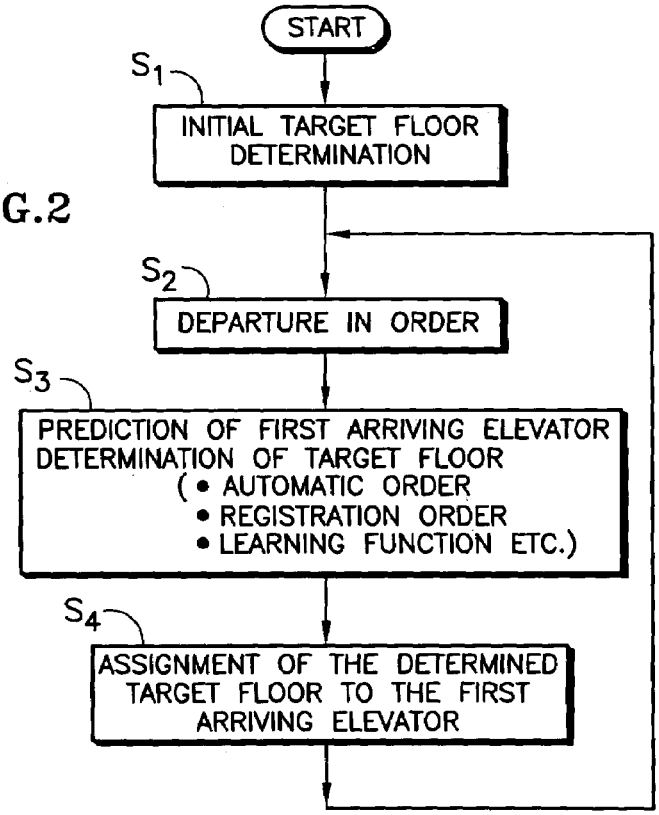
FIG. 2 is a flow chart for the processing carried out by the elevator operation system in an embodiment of this invention.

FIG. 1 is a diagram illustrating the principle of operation when this invention is adopted in a conventional elevator. FIG. 2 is a flow chart illustrating processing performed by the computer of the operation system in this invention.

According to this invention, first of all, plural elevator units A-C are each assigned to a unique service floor that is different from the others (step $S_1$). As indicated by the hatched portions in FIG. 1, the $10^{th}$ floor is assigned as the target floor for first-departing unit A; the $4^{th}$ floor is assigned as the target floor for the next-departing unit B; and the $7^{th}$ floor is assigned as the target floor for the last-departing unit C.

Then, an operation mechanism not shown in the figure drives the elevators sequentially to the respective service floors (step $S_2$).

Then, in step $S_3$, the computer in the operation system predicts which elevator among the plural elevators will return first to the building ground floor lobby on the basis of the car position detection information, etc. Also in step $S_3$, said computer determines the target floor for the first-departing elevator as the service floor selected from among said preset service floors ($4^{th}$, $7^{th}$, or $10^{th}$ floor) corresponding to the target floor requests.

Determination of the target floor is carried out using the following means.

(1) Automatic sequential assignment. In this case, assignment is performed in the order preset in the initial stage of step $S_1$.

(2) Time-priority assignment with respect to target floor registration input order priority.

(3) Automatic assignment by means of a group management learning function (wait time, service time, number of passengers using it).

(4) Combination of said (1)–(3).

Figure 3A:
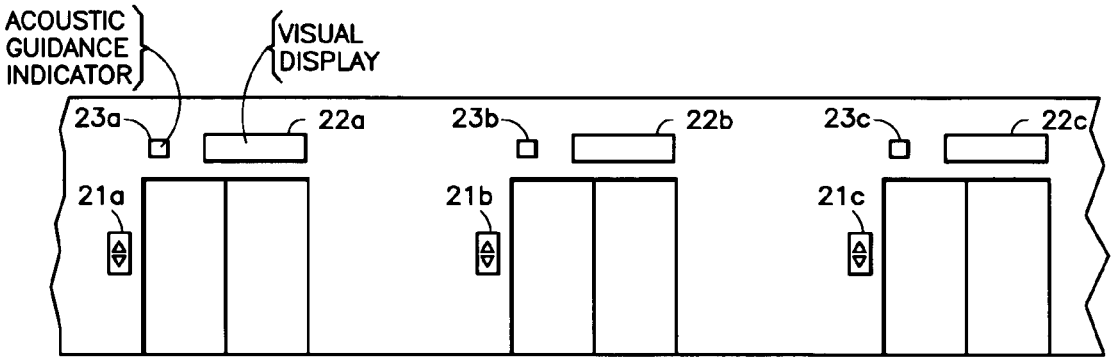
FIG. 3 is a diagram illustrating the constitution of the main portion of the elevator operation system in an embodiment of this invention.
Figure 3B:
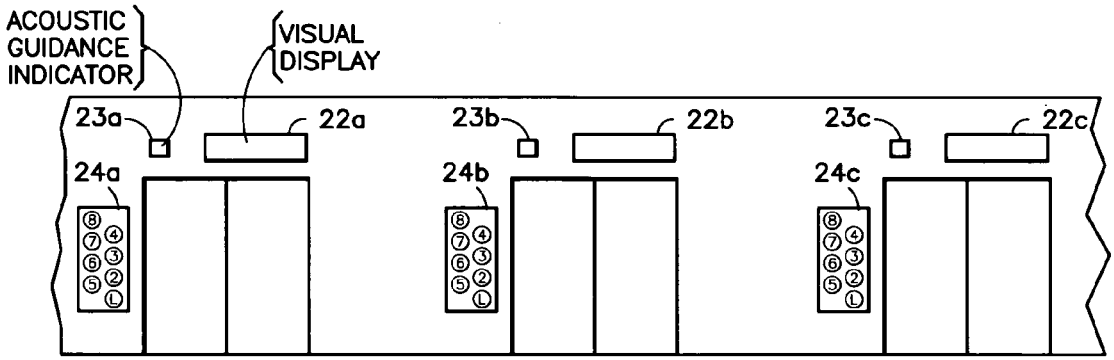
Figure 6:
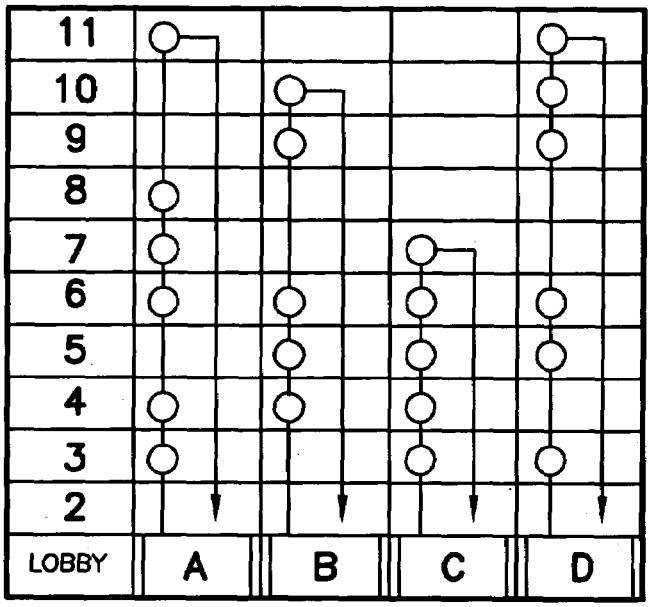
FIG.6 Prior Art
FIG. 6 is a diagram illustrating an example of a prior art conventional elevator operation method.
Figure 7:
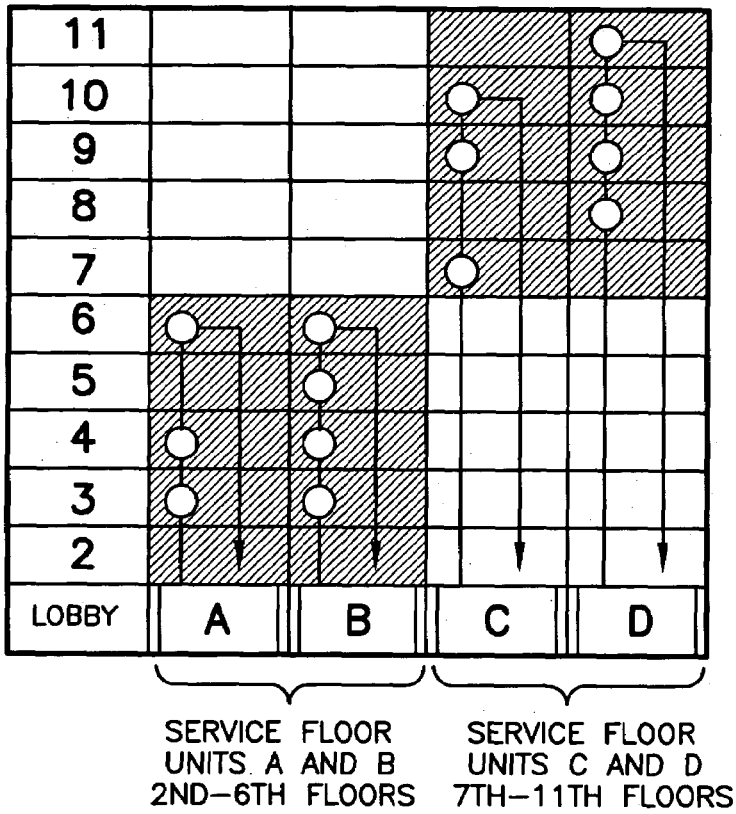
FIG.7 Prior Art
FIG. 7 is a diagram illustrating another example of a prior art conventional elevator operation method.
Figure 8:
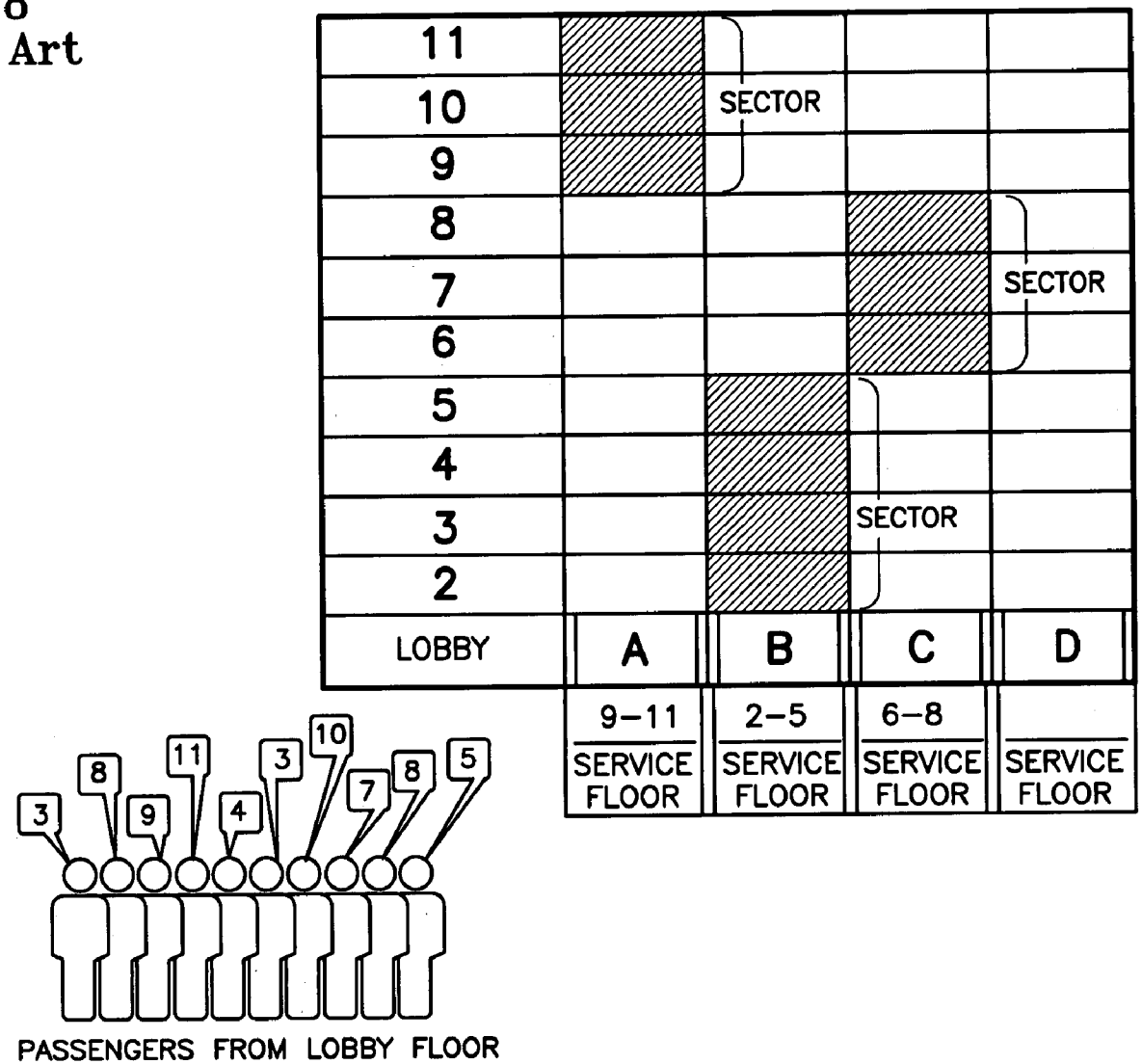
FIG.8 Prior Art
FIG. 8 is a diagram illustrating another example of a prior art conventional elevator operation method.
Figure 9:
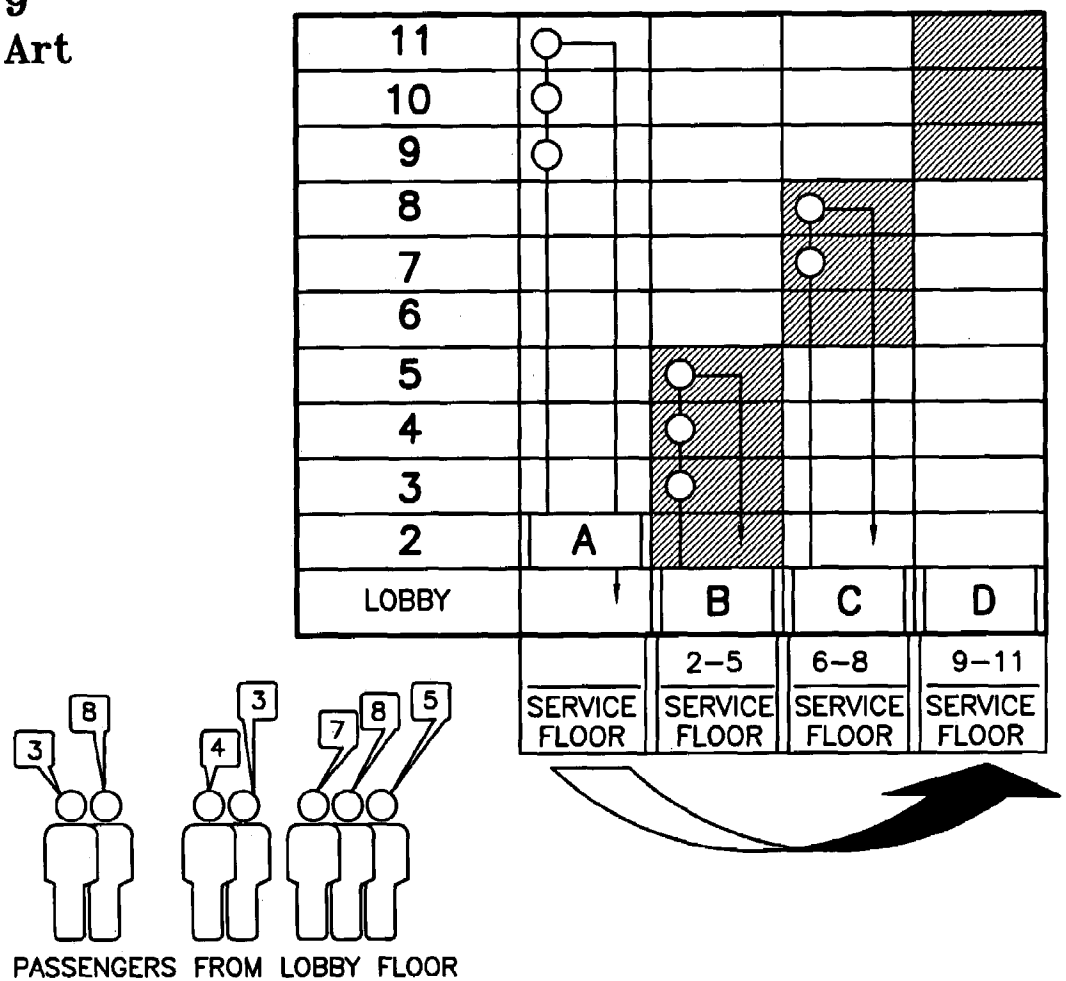
FIG.9 Prior Art
FIG. 9 is a diagram illustrating another example of a prior art conventional elevator operation method.
Figure 10:
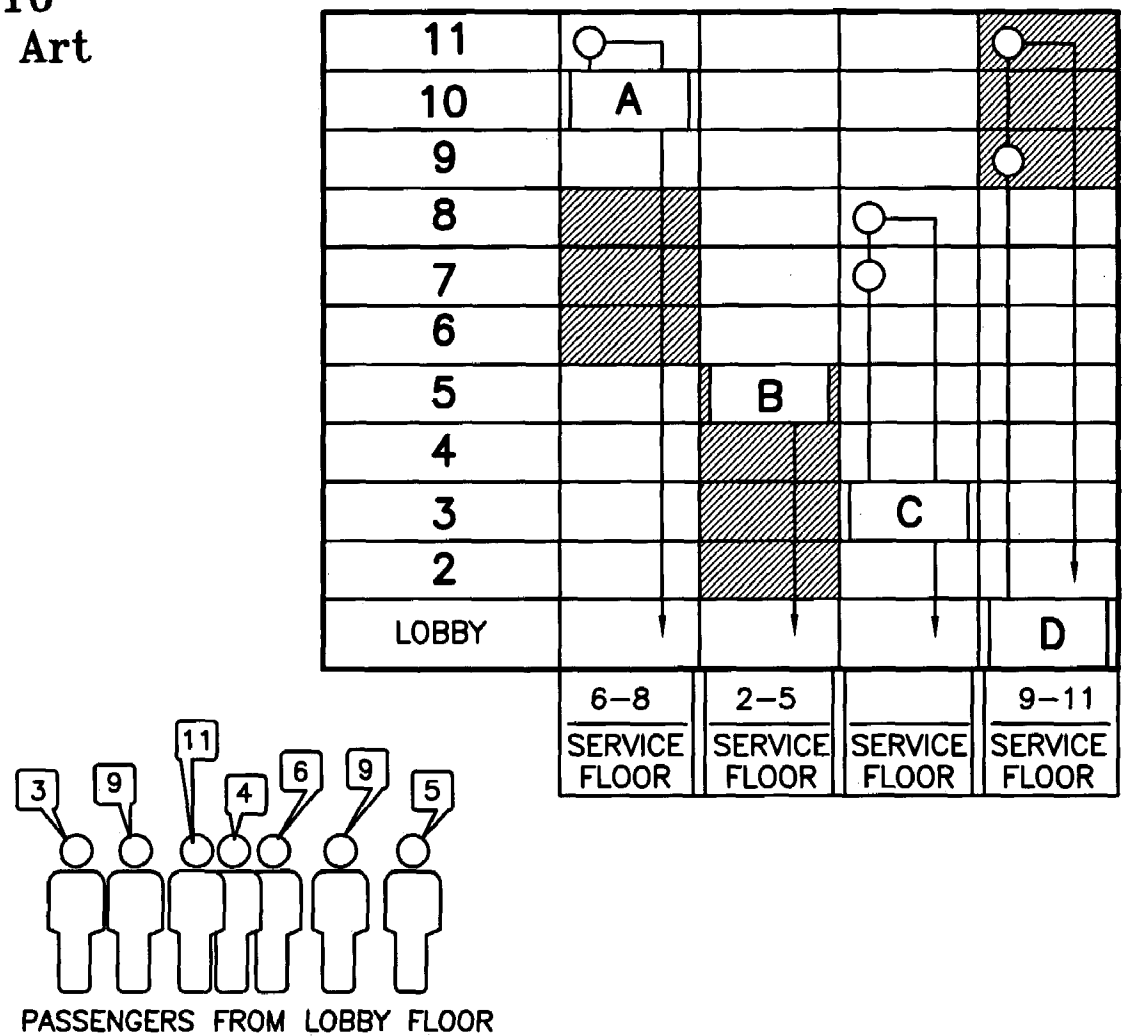
FIG. 10 Prior Art
FIG. 10 is a diagram illustrating another example of a prior art conventional elevator operation method.
Figure 11:
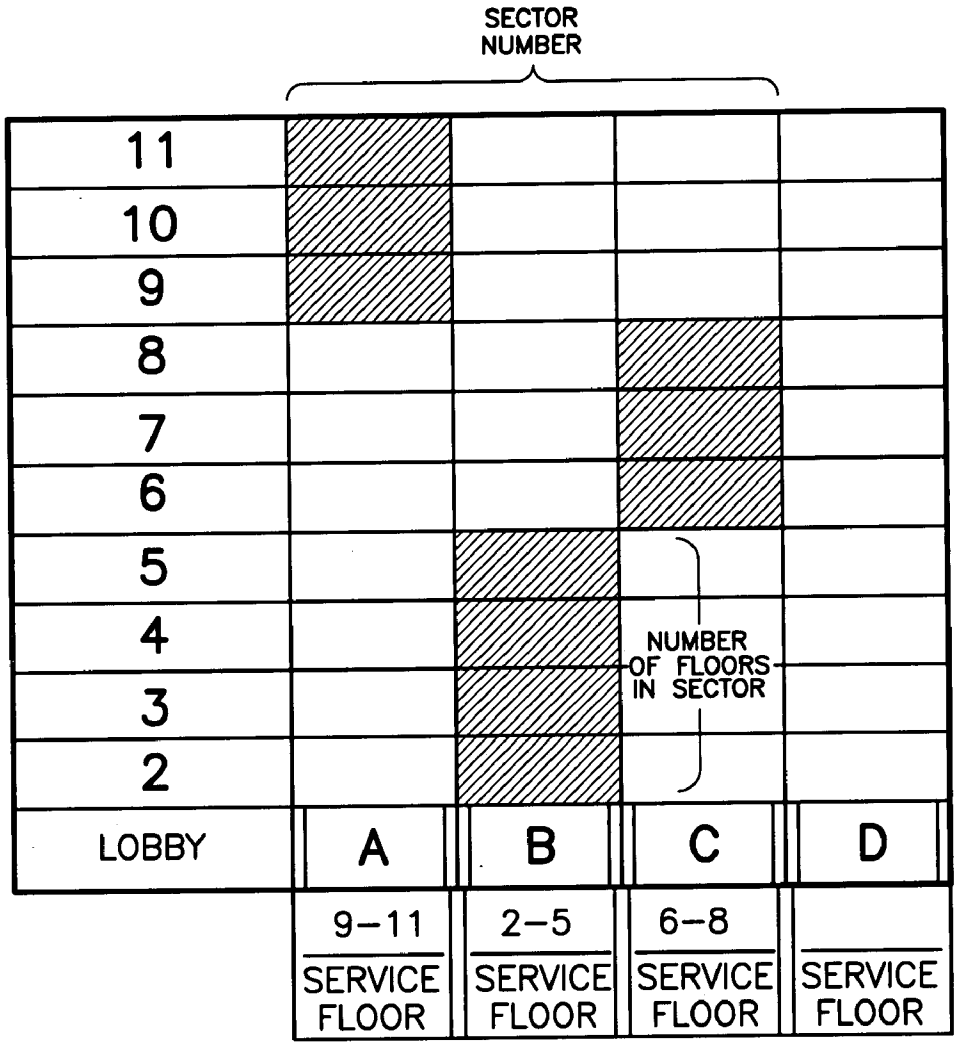
FIG.11 Prior Art
FIG. 11 is a diagram illustrating another example of a prior art conventional elevator operation method.
Figure 12:
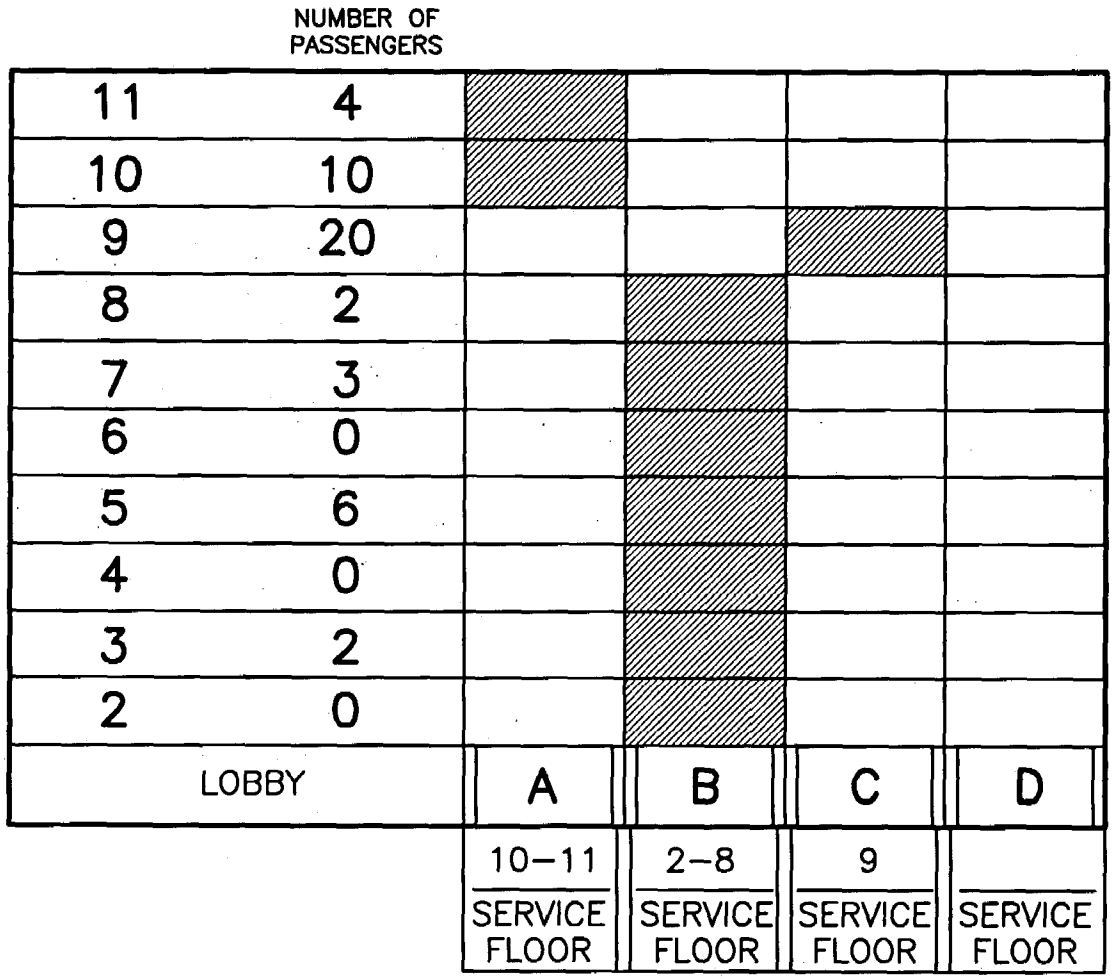
FIG.12 Prior Art
FIG. 12 is a diagram illustrating another example of a prior art conventional elevator operation method.
Figure 13:
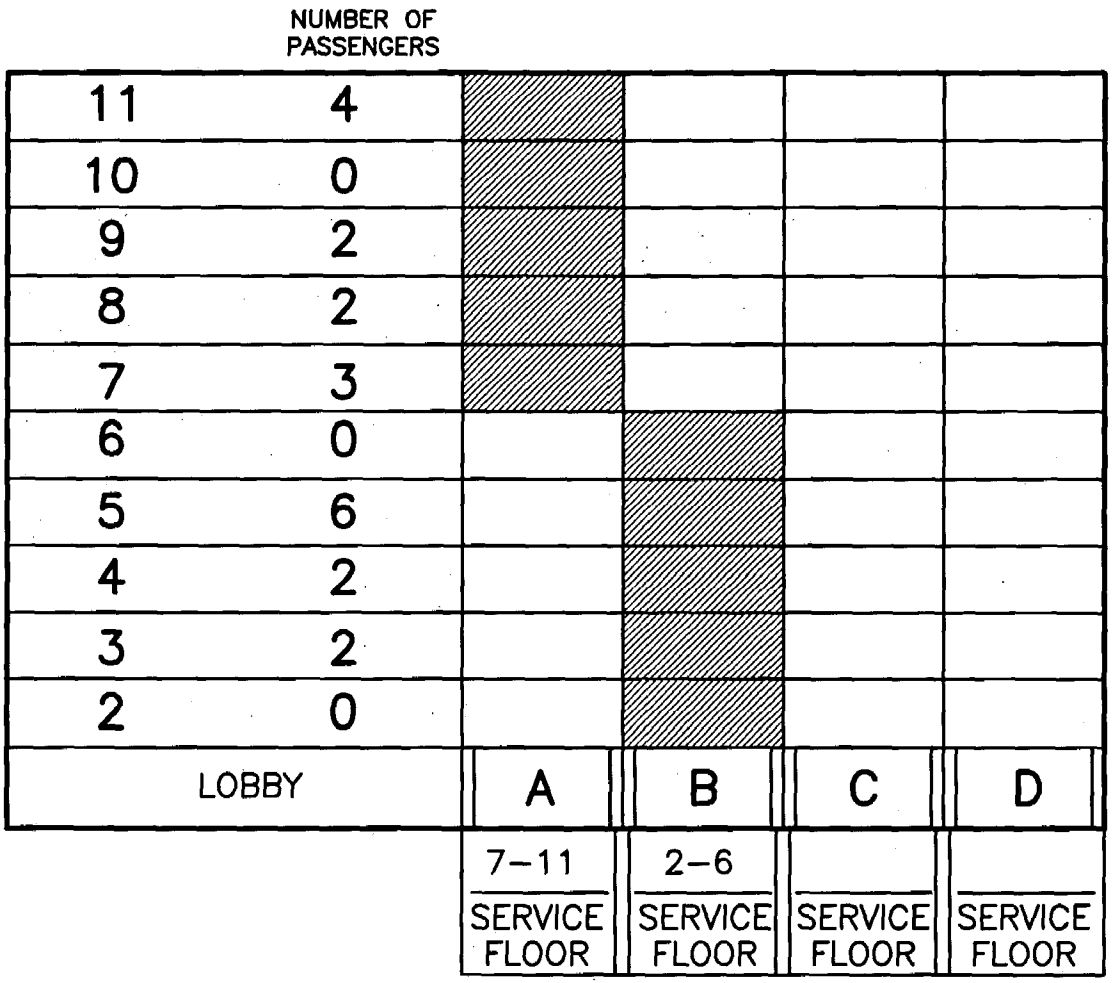
FIG.13 Prior Art
FIG. 13 is a diagram illustrating another example of a prior art conventional elevator operation method.

Call registration for said elevator can be carried out using various means, such as target floor direction buttons (21*a*)–(21*c*) on the lobby floor as shown in FIG. 3(*a*), target floor registration buttons (24*a*)–(24*c*) on the lobby floor as shown in FIG. 3(*b*), or various types of sensors (IR, electromagnetic waves, magnetism, gravity, light, heat, sound, etc.).

Then, in step $S_4$, the computer of the operation system assigns the aforementioned determined target floor to the aforementioned predicted first-arriving elevator, and the operation system then causes the elevator to depart for the assigned service floor (step $S_2$).

Also, as shown in FIG. 3, guidance to the elevator needed by the passengers is performed using a target lobby visual display such as lamps, LEDs, displays (22*a*)–(22*c*), and/or an acoustic guidance indicator such as speakers (23*a*)–(23*c*).

According to this invention, the service floor when the elevator departs from the lobby floor is determined (assigned) from among the preset service floors (a unique service floor for each elevator), such as the $4^{th}$ floor, $7^{th}$ floor and $10^{th}$ floor in the case shown in FIG. 1.

Because there is only a single service floor assigned to each elevator, the round trip time for the car to complete service and return to the departure floor becomes very short. That is, because all of the passengers riding on the same car go to the same target floor, it is possible to avoid the loss time that would be generated in the prior art for the passengers standing near the door to get off the car to make way for the passenger standing of the back wall, and then to get back on again. As a result, the overall average round trip time becomes much shorter than that in the prior art, and the overall average 5-min transporting ability is increased significantly.

FIG. 4 is a diagram illustrating the operation pattern when this invention is adopted for the shuttle elevators in a 500-m class skyscraper having several sky lobbies. It is compared to the conventional operation pattern.

In this figure, "P" stands for the elevator pit; "M" stands for the mechanical chamber; and "L" stands for the lobby. The densely hatched areas indicate the service floors (stop floors), and the widely hatched areas indicate the express region (nonstop floors).

As shown in FIG. 4, it is assumed that sky lobby (a) is at a height of 200 m, sky lobby (b) is a height of 300 m, and sky lobby (c) is at a height of 400 m.

In the system of this invention, sky lobby (a) is the only target lobby for the first-departing elevator on the building lobby floor; sky lobby (b) is the only target lobby for the next-departing elevator; and sky lobby (c) is the only target lobby for the last-departing elevator.

Consequently, when the operation method of this invention illustrated in said FIGS. 1–3 is adopted, the round trip time and average round trip time can be reduced by comparison to the conventional operation method, as indicated in the figure, and the transporting ability and average transporting ability (per 5 min) are increased, as shown in the figure.

For example, when this invention is adopted, the average round trip time for sky lobby (a) is 117.45 sec, and this is only 57.55% that of the prior art. For sky lobby (b), the average round trip time is 142.45 sec, and this is 69.80% that of the prior art. For sky lobby (c), the average round trip time is 167.45 sec, and this is 82.05% that of the prior art. For sky lobby (a), the 5-min transporting ability is 112.38 passengers, 173.34% that in the prior art. For sky lobby (b), the 5-min transporting ability is 92.66 passengers, 143.25% that in the prior art. For sky lobby (c), the 5-min transporting ability is 78.82 passengers, 121.86% that in the prior art. The overall average round trip time is 142.45 sec, 69.80% that in the prior art. The overall average 5-min transporting ability is 94.62 passengers, 146.28% that in the prior art.

Consequently, comparison of this invention to the prior art with respect to rush hour requirements shows that the elevator system can use ⅔ the number of elevator cars used in the prior art.

FIG. 5 is a diagram comparing to the prior art the operation pattern when this invention is applied in the elevator system of a relatively low building with a height of about 40 m (meeting hall, movie theater, store).

In this figure, "P" stands for the elevator pit; "M" stands for the mechanical chamber; and "L" stands for the lobby. The densely hatched areas indicate the service floors (stop floors), and the widely hatched areas indicate the express region (nonstop floors).

In FIG. 5, it is assumed that service floor (a) is at a height of 10 m, service floor (b) is at a height of 20 m, and service floor (c) is at a height of 30 m.

In the system of this invention, for the first-departing elevator in the building lobby, the target is taken to be only the single service floor (a). For the next-departing elevator, the target is only service floor (b). For the last-departing elevator, the target is only service floor (c).

As shown in the figure, by adopting the operation method of this invention, described above with reference to FIGS. 1–3, the round trip time and average round trip time are shorter, and the transporting ability and average transporting ability (per 5 min) are higher by comparison to the conventional operation method.

For example, when this invention is adopted, the average round trip time for service floor (a) is 67.78 sec, 57.40% that of the prior art. For service floor (b), the average round trip time is 81.12 sec, 68.70% that of the prior art. For service floor (c), the average round trip time is 94.45 sec, 78.89% that of the prior art. For service floor (a), the 5-min transporting ability is 97.37 passengers, 174.18% that in the prior art. For service floor (b), the 5-min transporting ability is 81.36 passengers, 145.54% that in the prior art. For service floor (c), the 5-min transporting ability is 69.88 passengers, 125.00% that in the prior art. The overall average round trip time is 81.11 sec, 68.70% that in the prior art. The overall average 5-min transporting ability is 82.87 passengers, 148.24% that in the prior art.

Consequently, comparison of this invention to the prior art with respect to rush hour requirements shows that the elevator system can use ⅔ the number of elevator cars used in the prior art.

This invention is not limited to the aforementioned embodiments. It can also be adopted together with the conventional method, such as the operation method shown in FIGS. 6–13 corresponding to the operation time, needs of passengers, and other conditions. Also, the means for setting the unique service floor that is different from the others for each of said elevators and the setting processing are not limited to the floors shown in the aforementioned embodiments. Also, the number of sky lobbies and the number of elevator cars are not limited to those described in the aforementioned embodiments. Other numbers can be adopted. The preceding description is exemplary rather than limiting in nature. Variations and modifications to the disclosed examples may become apparent to those skilled in the art that do not necessarily depart from the purview and spirit of this invention. The scope of legal protection given to this invention can only be determined by studying the following claims.

I claim:

1. An elevator system for operating a plurality of elevators in a building comprising;

a call registration device for entering a destination floor request;

a target floor determining means that determines a target floor corresponding to the destination floor request;

a target floor assigning means for assigning the target floor to one of the plurality of elevators for service exclusively to the target floor, and; a first-arriving elevator predicting means that predicts a first arriving elevator among said plurality of elevators to arrive at a building ground floor lobby and wherein said target floor assigning means assigns said target floor to the first arriving elevator.

2. The elevator system of claim 1 further comprising a visual display located near each of the plurality of elevators to indicate the target floor assigned to each of the plurality of elevators.

3. The elevator system of claim 1 further comprising an acoustic device located near each of the plurality of elevators to indicate the target floor assigned to each of the plurality of elevators.

4. The elevator system of claim 1 wherein each of said plurality of elevators is restricted to serving a set of target floors.

5. An elevator operation method for operating plural elevators in a building comprising the steps of;

registering a destination floor request;

determining a target floor that corresponds to the destination floor request;

assigning the target floor to one of the plurality of elevators for service exclusively to the target floor, predicting a first arriving elevator from among said plurality of elevators to arrive at a building ground floor lobby; and, assigning said target floor to the first arriving elevator.

6. The method of claim 5 further comprising the step of indicating the one of the plurality of elevators to which the target call is assigned.

7. The method of claim 5 wherein the step of determining is restricted to a set of target floors for each one of the plurality of elevators.

* * * * *